US010583541B2

(12) United States Patent
Bridges et al.

(10) Patent No.: US 10,583,541 B2
(45) Date of Patent: Mar. 10, 2020

(54) TONGUE-AND-GROOVE PLIERS WITH ANTI-MARRING GRIP AREA

(71) Applicant: APEX BRANDS, INC., Apex, NC (US)

(72) Inventors: Tobias McKay Bridges, Holly Springs, NC (US); Jonathan Siebert Beckwith, Raleigh, NC (US); Randi Ligon, Apex, NC (US); John Griffin Biering, Jr., Charlotte, NC (US); Zachary Grant Hays, Belmont, NC (US); Trent Kahute, Atlanta, GA (US); Alexander Troitzsch, Atlanta, GA (US); Stephanie Lewis, Atlanta, GA (US); Justin Arsenault, Atlanta, GA (US); Alan David Anderson, Willow Spring, NC (US)

(73) Assignee: Apex Brands, Inc., Apex, NC (US)

( * ) Notice: Subject to any disclaimer, the term of this patent is extended or adjusted under 35 U.S.C. 154(b) by 209 days.

(21) Appl. No.: 15/654,744

(22) Filed: Jul. 20, 2017

(65) Prior Publication Data

US 2018/0021925 A1 Jan. 25, 2018

Related U.S. Application Data

(60) Provisional application No. 62/364,385, filed on Jul. 20, 2016.

(51) Int. Cl.
*B25B 7/04* (2006.01)
*B25B 7/12* (2006.01)
(Continued)

(52) U.S. Cl.
CPC ..... *B25B 7/04* (2013.01); *B25B 7/10* (2013.01); *B25B 7/12* (2013.01); *B25B 7/18* (2013.01); *B25G 1/105* (2013.01)

(58) Field of Classification Search
CPC .... B25B 7/04; B25B 7/10; B25B 7/12; B25B 7/18; B25G 1/105
(Continued)

(56) References Cited

U.S. PATENT DOCUMENTS 114,665 A * 5/1871 Garrick ..... B25B 7/02 7/125
1,949,335 A * 2/1934 Settles ..... B25F 1/006 254/28
(Continued)

FOREIGN PATENT DOCUMENTS

JP H027964 U 1/1990

*Primary Examiner* — Hadi Shakeri
(74) *Attorney, Agent, or Firm* — Burr & Forman, LLP

(57) ABSTRACT

A hand tool may include a head section defining a first grip portion, a handle section and a second grip portion. The head section includes a top jaw and a bottom jaw defining the first grip portion. The handle section includes a top handle and a bottom handle. The top jaw and the bottom handle forming a first unitary piece, and the bottom jaw and the top handle forming a second unitary piece. The first and second unitary pieces are joined at a pivot point. The second grip portion includes a top grip portion provided at the top handle and a bottom grip portion provided at the bottom handle. The top and bottom grip portions substantially face each other. The first grip portion is made of a metallic material and the second grip portion is made of a non-metallic material.

17 Claims, 5 Drawing Sheets

(51) Int. Cl.
*B25B 7/18* (2006.01)
*B25G 1/10* (2006.01)
*B25B 7/10* (2006.01)

(58) Field of Classification Search
USPC ..... 81/413, 414, 405
See application file for complete search history.

(56) References Cited

U.S. PATENT DOCUMENTS

| | | | | |
|---|---|---|---|---|
| 3,760,473 | A * | 9/1973 | Studdard | B23D 71/04 15/104.04 |
| 4,282,783 | A * | 8/1981 | Fortune | B25G 1/12 81/427.5 |
| 4,614,001 | A * | 9/1986 | Liou | B25F 1/006 7/137 |
| 4,658,456 | A * | 4/1987 | Tsai | B25B 7/00 7/135 |
| 5,014,379 | A | 5/1991 | Hull et al. | |
| 6,270,134 | B1 | 8/2001 | Lin | |
| 6,725,486 | B2 | 4/2004 | Oka | |
| 6,776,073 | B1 | 8/2004 | Brady et al. | |
| 7,966,681 | B2 * | 6/2011 | Harris | B25B 7/02 7/142 |
| 8,136,188 | B2 | 3/2012 | Bell | |
| 8,661,948 | B2 | 3/2014 | DeBaker et al. | |
| 8,707,833 | B1 | 4/2014 | Gedeon | |
| 2006/0236823 | A1 | 10/2006 | MacLain | |
| 2014/0047956 | A1 | 2/2014 | DeBaker et al. | |
| 2014/0157524 | A1 * | 6/2014 | Mote | B25F 1/003 7/156 |
| 2019/0084130 | A1 * | 3/2019 | Buchanan | B25B 7/14 |

* cited by examiner

TONGUE-AND-GROOVE PLIERS WITH ANTI-MARRING GRIP AREA

CROSS REFERENCE TO RELATED APPLICATIONS

This application claims priority to U.S. application No. 62/364,385 filed Jul. 20, 2016, the entire contents of which is hereby incorporated by reference in its entirety.

TECHNICAL FIELD

Example embodiments generally relate to hand tools and, in particular, relate to tongue-and-groove pliers that are provided with an anti-marring grip area.

BACKGROUND

Hand tools are commonly used across all aspects of industry and in the homes of consumers. Hand tools are employed for multiple applications including, for example, tightening, component joining, and/or the like. For some component joining applications, a tongue-and-groove pliers (e.g., a channel lock, pipe spanner, adjustable pliers, slip joint pliers, etc.) may be preferred. Tongue-and-groove pliers typically have serrated jaws that are set from 45 to 60 degrees out of alignment with the handles and allow one of the jaws (typically the lower jaw) to be moved to a number of different selectable positions relative to the other jaw (typically the upper jaw). The different positions are each defined by separate tracks or grooves defined in a portion of the upper jaw. The lower jaw can then be selectively placed in each respective one of the tracks or grooves to define the distance between the jaws (which gets larger as the distance between the handles gets smaller).

Tongue-and-groove pliers are very commonly used for holding nuts and bolts, clamping materials, or gripping larger or irregular shaped objects. Because of this ability to grip larger objects, tongue-and-groove pliers often make a good choice for plumbers and homeowners engaged in pipe joining applications. In these applications, tongue-and-groove pliers are sometimes used to join pipes that remain out of the view under normal circumstances. The serrated jaws therefore can be used without regard for marring or scratching the surfaces of the pipes or pipe joining components that are to be engaged. However, in some cases, certain components upon which the tongue-and-groove pliers may be desirable for use may be visible or even decorative (e.g., polished) in nature. Using the serrated jaws without protection may therefore be undesirable since the surface of the components may be marred or scratched.

BRIEF SUMMARY OF SOME EXAMPLES

Some example embodiments may enable the provision of tongue-and-groove pliers that not only have the familiar serrated jaws of adjustable size, but are also provided with an anti-marring grip area that has an adjustable size.

In an example embodiment, a hand tool may be provided. The hand tool may include a head section defining a first grip portion, a handle section and a second grip portion. The head section includes a top jaw and a bottom jaw defining the first grip portion. The handle section includes a top handle and a bottom handle. The top jaw and the bottom handle forming a first unitary piece, and the bottom jaw and the top handle forming a second unitary piece. The first and second unitary pieces are joined at a pivot point. The second grip portion includes a top grip portion provided at the top handle and a bottom grip portion provided at the bottom handle. The top and bottom grip portions substantially face each other. The first grip portion is made of a metallic material and the second grip portion is made of a non-metallic material.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
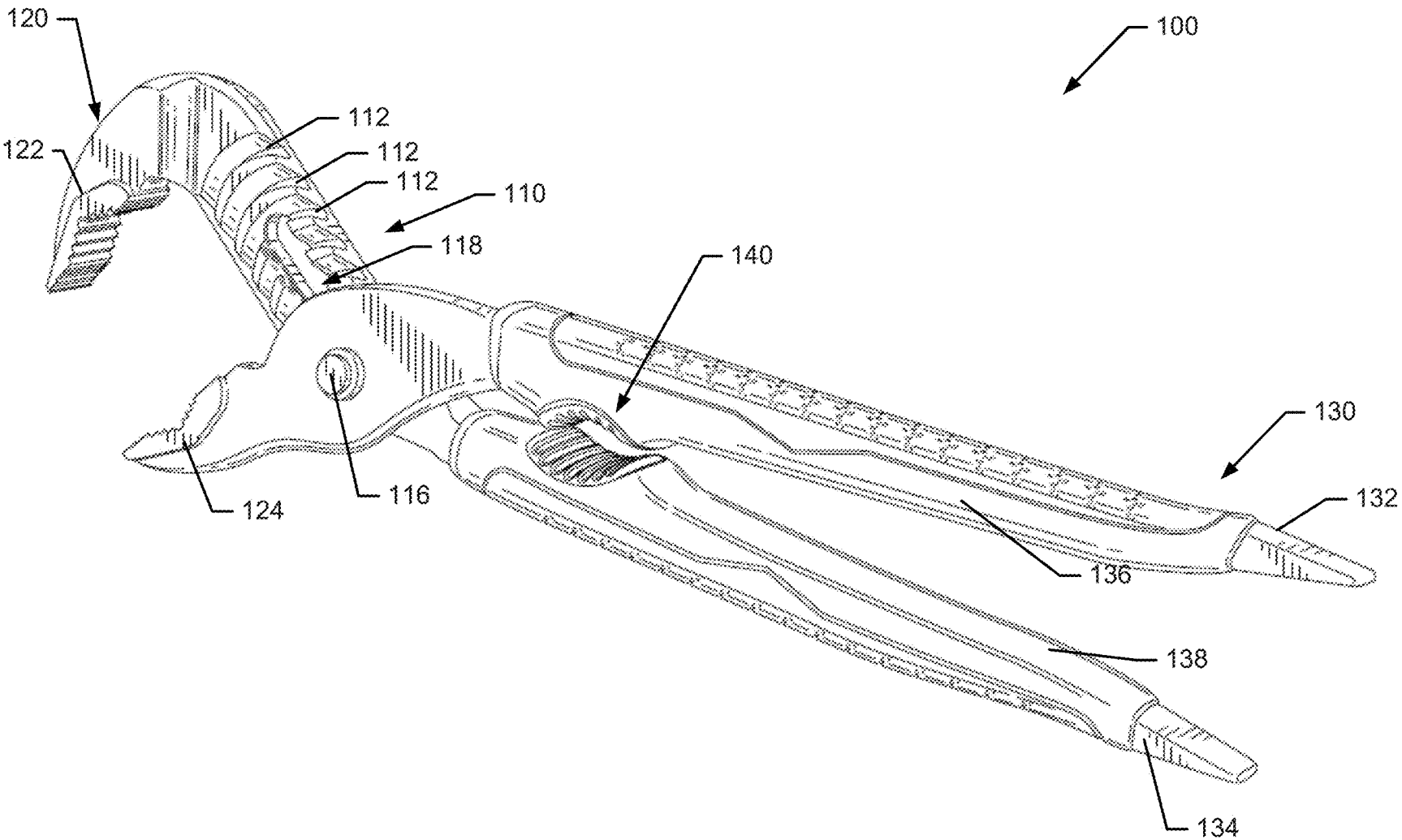
FIG. 1 illustrates a perspective view of tongue-and-groove pliers with an anti-marring grip area and jaws set at the largest size according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of tongue-and-groove pliers that employ an anti-marring grip area. FIGS. 1-9 show various views or portions of one such example embodiment. In this regard, FIG. 1 illustrates a perspective view of a hand tool 100 (e.g., tongue-and-groove pliers) having a size adjustment assembly 110. The size adjustment assembly 110 includes a series of channels or grooves 112, which each define a position in which a tongue 114 may be slidably engaged to define the different sizes that can be provided for a head section 120 of the hand tool 100. The size adjustment assembly 110 may be disposed between the head section 120 and a handle section 130 of the hand tool 100.

Figure 8:
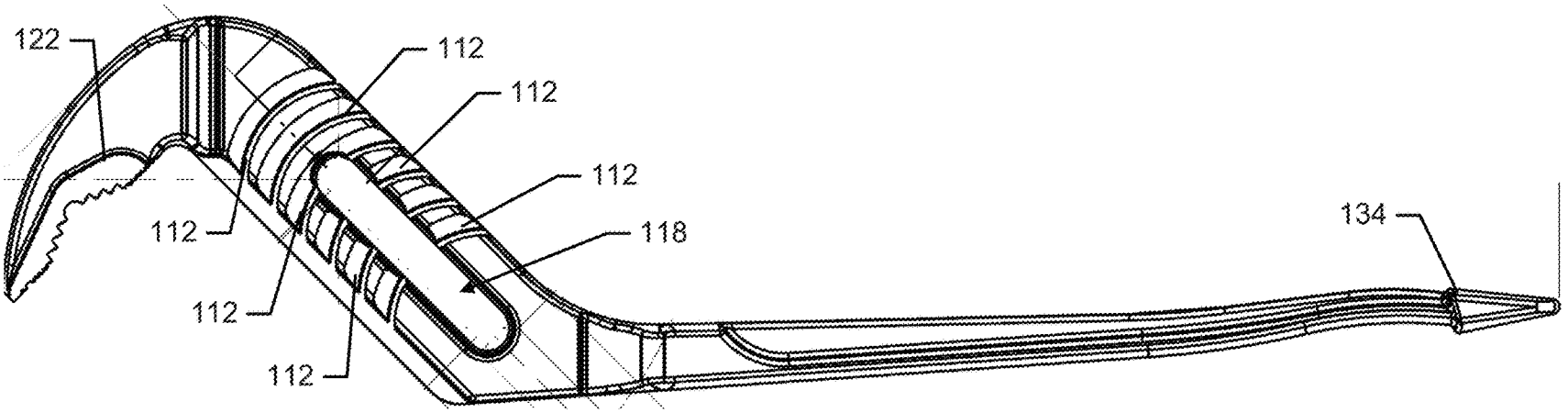
FIG. 8 illustrates a side view of one of the handle members (having the upper jaw) of the tongue-and-groove pliers without the handle grip applied according to an example embodiment.
Figure 9:
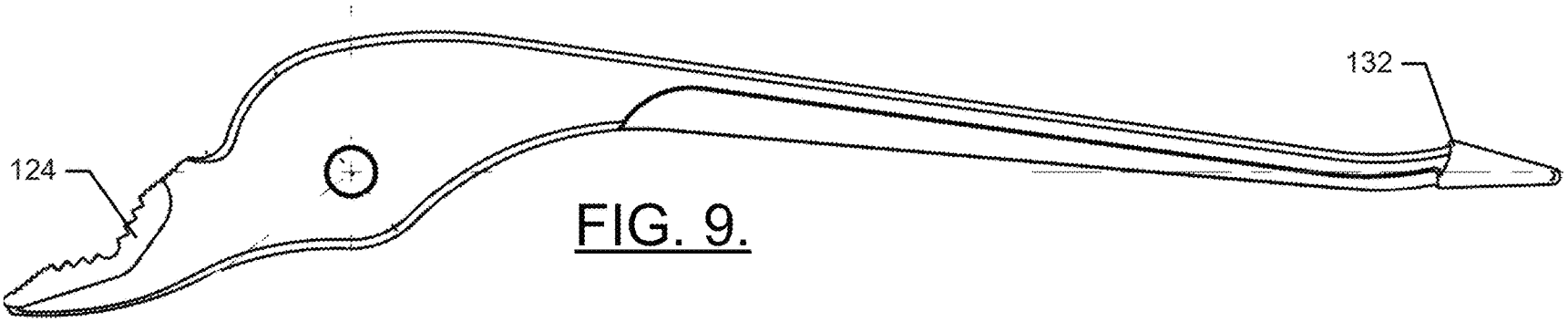
FIG. 9 illustrates a side view of the other one of the handle members (having the lower jaw) of the of the tongue-and-groove pliers without the handle grip applied according to an example embodiment.

The head section 120 includes a top jaw 122 and a bottom jaw 124, and the handle section 130 includes a top handle 132 and a bottom handle 134. As can be appreciated from FIGS. 1-3, for example, the top jaw 122 and bottom handle 134 form one unitary piece that is operably coupled to the bottom jaw 124 and the top handle 132 at the size adjustment assembly 110. The bottom jaw 124 and the top handle 132 also form a single unitary piece with each other. The single unitary piece comprising the top jaw 122 and bottom handle 134 is shown in FIG. 8. The single unitary piece comprising the bottom jaw 124 and top handle 132 is shown in FIG. 9.

The operable coupling of the top jaw 122 and bottom handle 134 to the bottom jaw 124 and the top handle 132 is accomplished in this example via the size adjustment assembly 110. The top jaw 122 and bottom handle 134 may be formed of a rigid metallic material (e.g., iron or steel, such as induction hardened steel) and the bottom jaw 124 and the top handle 132 may be similarly formed of a rigid metallic material (e.g., the same material used to form the top jaw 122 and bottom handle 134). In an example embodiment, at least some of the metallic portions of the hand tool 100 may be covered with a corrosion resistant finish (e.g., a black-oxide finish).

Lengths of the top jaw 122 and bottom handle 134 and of the bottom jaw 124 and the top handle 132 may be selected to provide any desirable length for the hand tool 100. For example, 10 inch, 12 inch, 14 inch, or any other desirable lengths may be employed within the scope of example embodiments. Similarly, it should be appreciated that any desirable number of grooves 112 can be provided to increase or decrease the number of variable grip sizes that can be achieved for the top jaw 122 and the bottom jaw 124 via the size adjustment assembly 110. However, the example depicted in FIGS. 1-9 has six grooves 112, and therefore has six corresponding different adjustable positions and corresponding grip sizes.

The top jaw 122 and bottom jaw 124 of the head section 120 may form a first grip portion. The size adjustment assembly 110 is operated between one of two different states including a size adjustment state and a gripping state. When in the size adjustment state, the tongue 114 is not in any one of the grooves 112. When in the gripping state, the tongue 114 is slidably engaged in one of the grooves 112 to define a corresponding grip size of the first grip portion. The size adjustment assembly 110 further includes a pivot point (e.g., rivet 116) that slides to various locations within a slot 118 provided through at least some of the grooves 112. In an example embodiment, the tongue 114 and rivet 116 are provided between the bottom jaw 124 and the top handle 132, and the grooves 112 and slot 118 are provided between the top jaw 122 and the bottom handle 134. The slot 118 may extend along a direction parallel to the direction of extension of the sequential positioning of the grooves 112. As such, the slot 118 may bisect at least some of the grooves 112 (e.g., all but two of the grooves 112). The two grooves 112 that are not bisected by the slot 118 may define the smallest grip sizes of the hand tool 100. Meanwhile, at the opposite end of the slot 118 (e.g., the end closest to the bottom handle 134), the largest grip sizes of the hand tool 100 may be defined by grooves 112 proximate thereto.

To adjust the grip size of the first grip portion, the top handle 132 and the bottom handle 134 may be spread apart from each other until the tongue 114 is no longer inside one of the grooves 112 thereby entering the size adjustment state. The rivet 116 can then be slid to any desirable position of the slot 118. The tongue 114 can then be aligned with a desired groove 112 and slid therein to define a corresponding grip size of the first grip portion and transition the hand tool 100 to the gripping state. In the gripping state, the top handle 132 and the bottom handle 134 may be opened and closed (e.g., moved away from and toward each other), while keeping the tongue 114 at least partially in the desired groove 112. Thus, although the top handle 132 and the bottom handle 134 are spread apart from each other in the gripping state, they are not spread apart from each other far enough to remove the tongue 114 from the groove 112.

The first grip portion may have serrated projections (e.g., teeth) of at least two sizes on respective different portions thereof. The serrated projections may be smaller at a flat grip portion, and may be larger at an angled grip portion. The flat grip portion may extend on opposite sides of the angled grip portion. The flat grip portions of the top jaw 122 and bottom jaw 124 may be capable of lying parallel to each other through at least one portion of the range of motion of the handles of the handle portion 130. However, when the handle portion 130 is fully closed such that the top handle 132 and bottom handle 134 are as close together as possible for a given position, the flat grip portion of the top jaw 122 and the flat grip portion of the bottom jaw 124 may be angled slightly toward each other. As such, in the smallest grip size, only the distal ends of the flat grip portion of the top jaw 122 and the flat grip portion of the bottom jaw 124 may contact each other in a pincer movement.

The angled grip portion of each of the top jaw 122 and bottom jaw 124 may include surfaces that are angled relative to each other by about 60 degrees (e.g., to form a V-shape). Each of the angled surfaces of the angled grip portion may further include serrated projections (e.g., teeth) that are, as mentioned above, larger than the serrated projections provided on the flat grip portion. The provision of the angled grip portion may allow round objects, irregular shaped objects, or certain regular shaped objects that are not flat to be gripped by the first grip portion. Thus, for example, a hex nut may be easily gripped within the angled grip portion. The serrated projections may, in some cases, be angled toward an apex of the V-shape.

Figure 2:
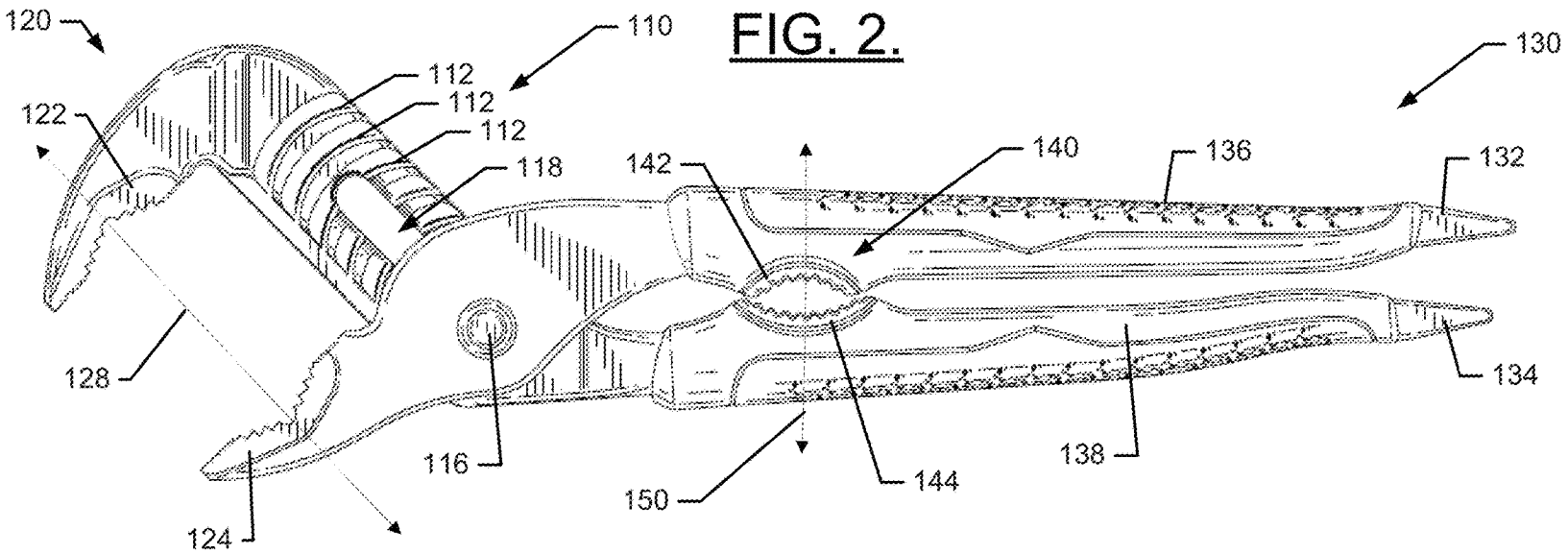
FIG. 2 illustrates a left side view of the tongue-and-groove pliers of FIG. 1 according to an example embodiment.
Figure 3:
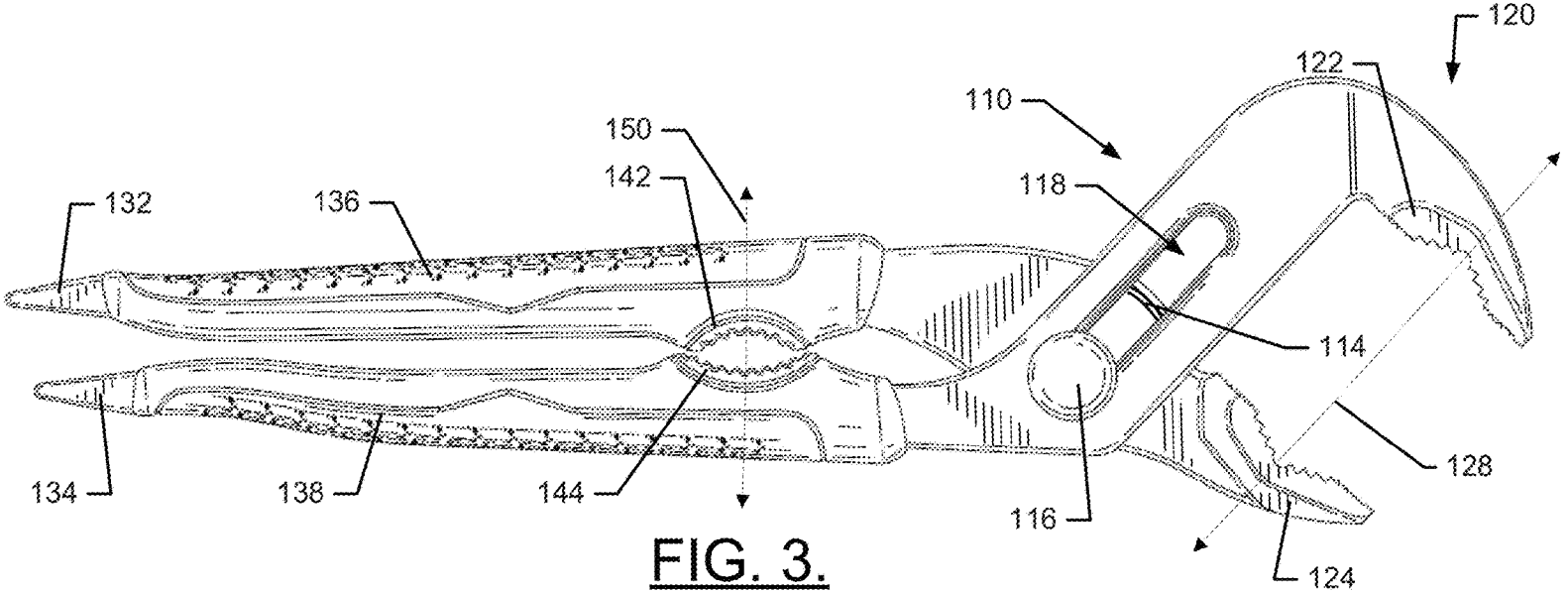
FIG. 3 illustrates a right side view of the tongue-and-groove pliers of FIG. 1 according to an example embodiment.
Figure 4:
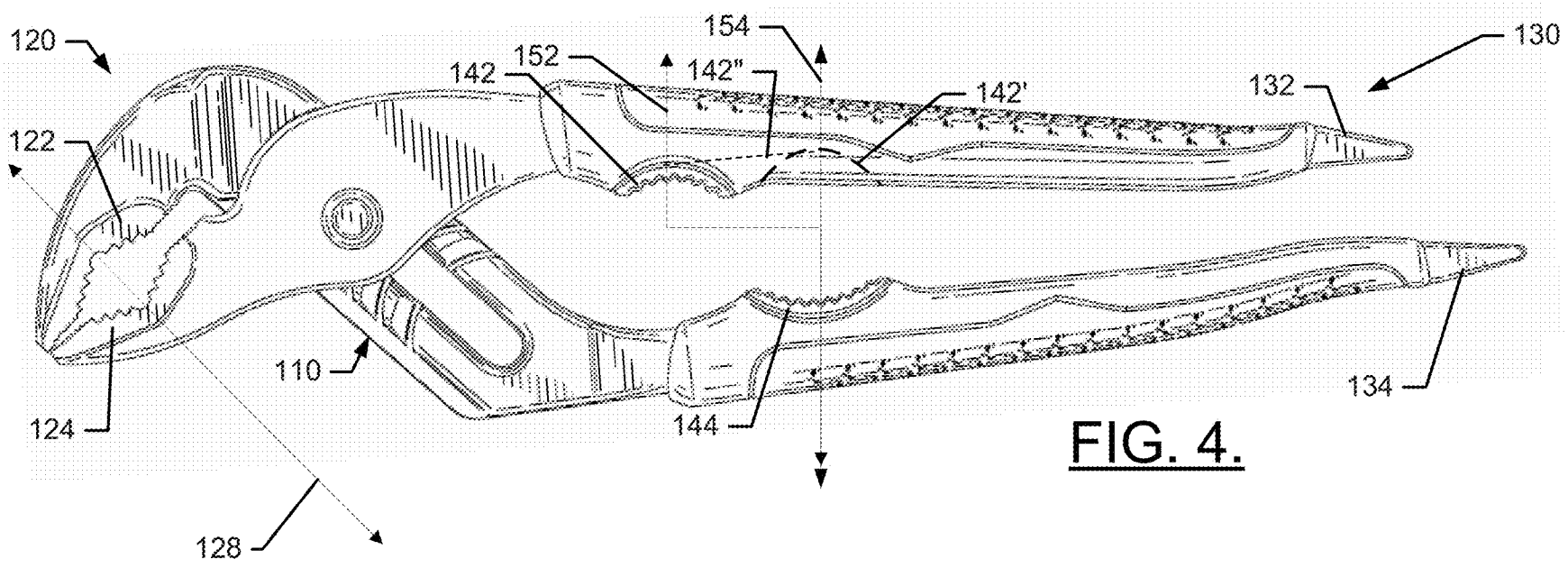
FIG. 4 illustrates a left side view of the tongue-and-groove pliers with the jaws set at the smallest size according to an example embodiment.

The top jaw 122 and bottom jaw 124 may stay substantially in alignment with each other throughout all grip sizes of the hand tool 100. In this regard, for example, when the handle section 130 is fully closed (e.g., such that the top handle 132 and bottom handle 134 are as close together as possible for a given position), the apexes of the angled grip portion of each of the top jaw 122 and the bottom jaw 124 may stay substantially aligned with each other throughout every possible grip size of the hand tool 100. Alignment line 128, which is shown in FIGS. 2-4, illustrates this alignment. In this regard, whereas FIGS. 2 and 3 illustrate the largest grip size and the alignment of the apexes of the angled grip portion, FIG. 4 illustrates the smallest grip size and the fact that the apexes of the angled grip portion are still substantially aligned with each other and fall along alignment line 128. The apexes may stay aligned similarly for all grip sizes in between as well.

In some example embodiments, each of the top handle 132 and the bottom handle 134 may have a non-metallic cover portion provided thereon. In this regard, the top handle 132 may have a top handle cover 136 and the bottom handle 134 may have a bottom handle cover 138 provided thereon. The top and bottom handle covers 136 and 138 may each be made of a non-metallic material such as a high impact rubber or plastic material. The top and bottom handle covers 136 and 138 may each have grip enhancing contact portions with patterns etched, molded, embossed or otherwise provided at the portions of the top and bottom handle covers 136 and 138 that face and engage with the hand of the user of the hand tool 100. The top and bottom handle covers 136 and 138 may extend over a majority portion of the top and bottom handles 132 and 134, respectively. However, end portions of the top and bottom handles 132 and 134 may each be exposed. Moreover, the end portions of the top and bottom handles 132 and 134 may each be substantially tapered or flattened to enable the end portions to be used for reaming or prying.

Figure 6:
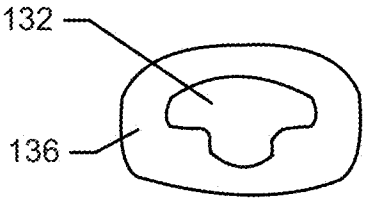
FIG. 6 illustrates a cross section view of a second point along one of the handle members of the tongue-and-groove pliers according to an example embodiment.
Figure 5:
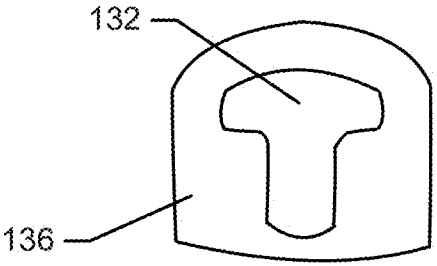
FIG. 5 illustrates a cross section view of a first point along one of the handle members of the tongue-and-groove pliers according to an example embodiment.

As can be appreciated from FIGS. 8 and 9, portions of the top and bottom handles 132 and 134 that are covered by the top and bottom handle covers 136 and 138, respectively, may not have a typical rectangular (or substantially rectangular) cross section, which other portions of the top and bottom handles 132 and 134 may otherwise have. Instead, at least some of the portions of the top and bottom handles 132 and 134 that are covered by the top and bottom handle covers 136 and 138, respectively, may have a T-shaped cross section, which is shown in FIGS. 5 and 6. The end portions may be wider in at least some (but in some cases not all) directions around the perimeter thereof than the top and bottom handle covers 136 and 138 to hold the top and bottom handle covers 136 and 138 in place.

As can be appreciated from FIGS. 5, 6, 8 and 9, the width of the T-shape (and the width of the top and bottom handles 132 and 134) may be substantially the same over the entire length of the respective handle. However, the height of the T-shape (i.e., the length of the base of the T) may decrease as the end of the respective handle is approached. The T-shape may allow the top and bottom handles 132 and 134 to maintain needed strength. However, the increasing size of the length of the T-shape may also provide structural features that enable the top and bottom handle covers 136 and 138 to be formed to fit the T-shape along their respective lengths so that when the top and bottom handle covers 136 and 138 are slid over ends of the top and bottom handles 132 and 134, respectively, and toward the head section 120, the top and bottom handle covers 136 and 138 will be allowed to slide forward until they are securely seated and fitted to the top and bottom handles 132 and 134, respectively.

As shown in FIGS. 1-4, the hand tool 100 further includes a second grip portion 140 (e.g., an anti-marring grip portion) that is disposed at a portion of the handle portion 130. More specifically, the second grip portion 140 may be formed to include portions provided in each of the top and bottom handle covers 136 and 138. Thus, for example, a top grip portion 142 may be provided on the top handle cover 136 and a bottom grip portion 144 may be provided on the bottom handle cover 138. The top and bottom grip portions 142 and 144 may be positioned to face each other, and may be positioned on an opposite side of the top and bottom handle covers 136 and 138 to the patterns of the grip enhancing contact portions thereof.

While the first grip portion is metallic, the second grip portion 140 is non-metallic. As such, even though both the first grip portion and the second grip portion 140 include serrated projections, the serrated projections of the second grip portion are able to provide gripping surfaces that will not mar or scratch metallic, plastic, composite or polished surfaces. In some cases, a hardness of the top and bottom grip portions 142 and 144 may be the same as or different from the hardness of the top and bottom handle covers 136 and 138. In an example embodiment, the hardness of the top and bottom grip portions 142 and 144 may be 55-60 on the Shore A hardness scale. Meanwhile, the top and bottom handle covers 136 and 138 may be 80-90 on the Shore A hardness scale. These values could be reversed or different in other example embodiments.

The top grip portion 142 and the bottom grip portion 144 may each be provided to have a curved or arcuate shape. In some cases, the radii of the top grip portion 142 and the bottom grip portion 144 could be the same or different. In cases where the radii of the top grip portion 142 and the bottom grip portion 144 are different, the radius of the top grip portion 142 may be smaller than the radius of the bottom grip portion 144 as shown in FIGS. 1-4. Thus, in such an example, the amount of curvature of the arc formed by the top grip portion 142 is greater or sharper than the amount of curvature of the arc formed by the bottom grip portion 144. However, in alternative embodiments, the reverse may be true. Because the radius of the top grip portion 142 is smaller than the radius of the bottom grip portion 144 in the depicted example, the length of the top grip portion 142 along the longitudinal length of the top handle 132 is smaller than the length of the bottom grip portion 144 along the longitudinal length of the bottom handle 134.

Figure 7:
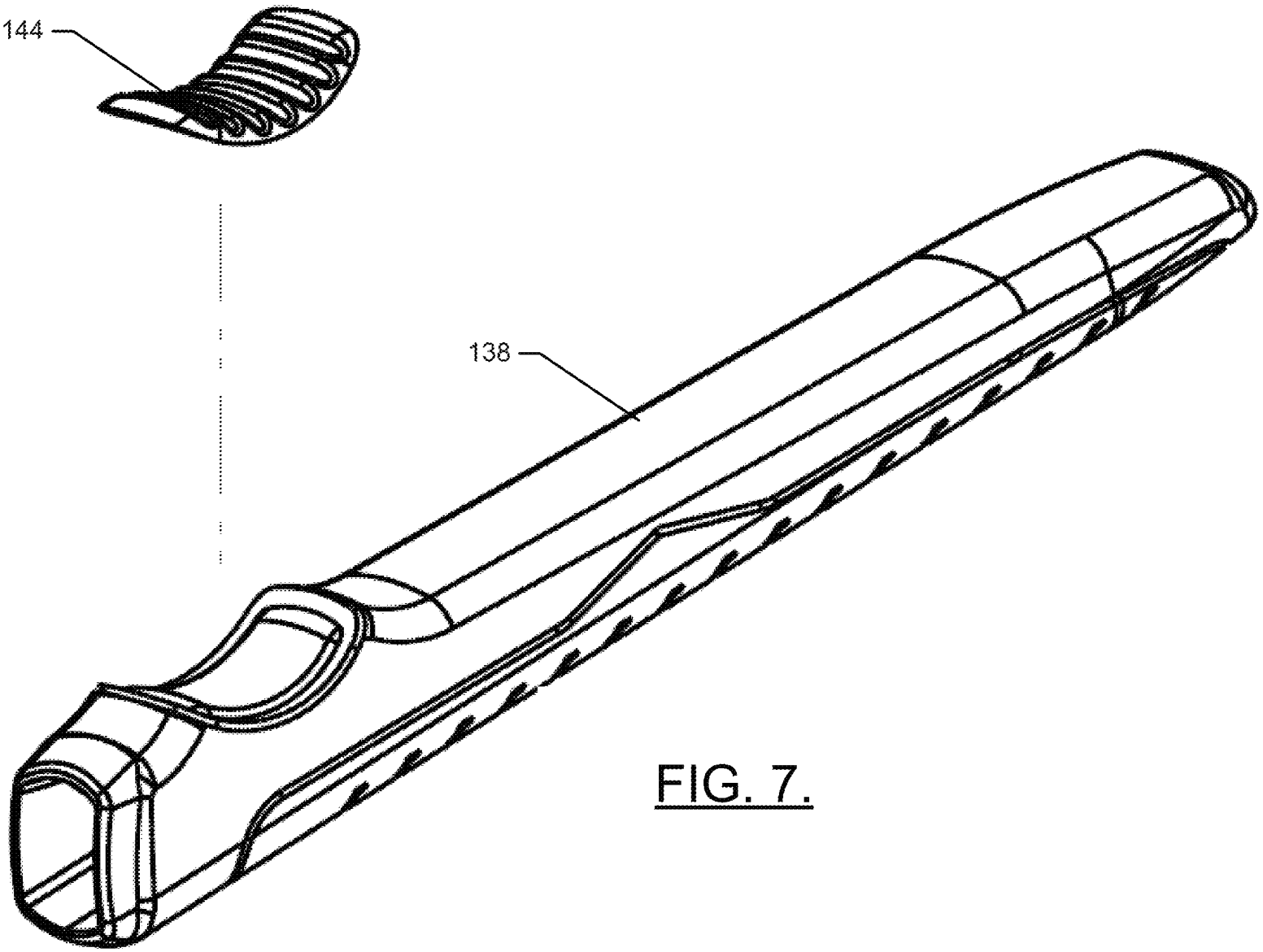
FIG. 7 illustrates a perspective view of a handle grip of the tongue-and-groove pliers according to an example embodiment.

FIG. 7 illustrates the bottom grip portion 144 removed from the bottom handle cover 138. In embodiments where an adhesive is used to join the bottom grip portion 144 and the bottom handle cover 138, FIG. 7 may represent the components before joining. However, in some example embodiments, the bottom grip portion 144 and the bottom handle cover 138 (and the top grip portion 142 and the top handle cover 136) may be joined to each other during the molding process or may be coextruded.

The provision of two different radii for the top grip portion 142 and the bottom grip portion 144 may allow the second grip portion 140 to provide a good gripping surface relative to more than one specific shape of pipe or other member that is to be gripped. For example, the larger radius (e.g., of the bottom grip portion 144) may provide a better grip on a larger diameter pipe, whereas the smaller radius (e.g., of the top grip portion 142) may provide a better grip on a smaller diameter pipe. However, it should also be appreciated that the alignment of the midpoint of the arcs of the second grip portion 140 of FIGS. 1-3 is only maintained at a single position of the size adjustment assembly 110. In this regard, line 150 shows the alignment of the midpoint of the top grip portion 142 with the midpoint of the bottom grip portion 144 while the first grip portion is positioned at the largest grip size (and the second grip portion 140 is positioned at its smallest grip size). As soon as the size adjustment assembly 110 is adjusted to a smaller grip size for the first grip portion, the grip size of the second grip portion 140 is increased, and the midpoints of the top and bottom grip portions 142 and 144 move out of alignment. In fact, when the grip size of the first grip portion is smallest, as shown in FIG. 4, the misalignment of the midpoints of the top and bottom grip portions 142 and 144 is largest.

Line 152 of FIG. 4 shows the misalignment of the midpoints of the top and bottom grip portions 142 and 144 when the grip size of the first grip portion is smallest. The misalignment may be an advantage relative to grasping some large or irregular shaped objects. However, to the extent that greater alignment is desired as the grip size of the second grip portion 140 increases, some example embodiments may include the addition of more than one top grip portion to provide more than one possible positions of alignment. In this regard, for example, FIG. 4 shows a second top grip portion 142' in dashed lines to illustrate the possible location of such an additional grip portion. The midpoint of the top grip portion 142 may align with the midpoint of the bottom grip portion 144 at the smallest grip size of the second grip portion 140, and the midpoint of the second top grip portion 142' may align with the midpoint of the bottom grip portion 144 at the largest grip size of the second grip portion 140.

In some example embodiments, the top grip portion 142 may be extended (e.g., to no longer be arc with a consistent radius) to cover the entire range from the forward-most portion of the top grip portion 142 to the rearward-most portion of the second top grip portion 142' as demonstrated by dashed line 142" in FIG. 4. In some cases, the top grip portion 142 and bottom grip portion 144 are generally provided near a forward (i.e., closest to the jaws) end of the handle section 130 so that the largest amount of force can be applied on the object being gripped.

As can be appreciated from the example of FIGS. 1-9, example embodiments may define a hand tool with an adjustable grip size for two different grip portions where the grip sizes of the respective different grip portions are inversely related to each other. In this regard, as the grip size of one grip portion decreases, the grip size of the other grip portion increases. Meanwhile, although one of the grip portions (i.e., the first grip portion) is maintained in alignment over all grip sizes achievable for the corresponding grip portion, the other grip portion is not maintained in alignment. However, additional grip portions may be provided for additional instances of alignment for the other grip portion (i.e., the second grip portion).

A hand tool may include a head section defining a first grip portion, a handle section and a second grip portion (e.g., a non-marking grip zone). The head section includes a top jaw and a bottom jaw defining the first grip portion. The handle section includes a top handle and a bottom handle. The top jaw and the bottom handle forming a first unitary piece, and the bottom jaw and the top handle forming a second unitary piece. The first and second unitary pieces are joined at a pivot point. The second grip portion includes a top grip portion provided at the top handle and a bottom grip portion provided at the bottom handle. The top and bottom grip portions substantially face each other. The first grip portion is made of a metallic material and the second grip portion is made of a non-metallic material.

The hand tool and/or its components may include a number of modifications, augmentations, or optional additions, some of which are described herein. For example, the hand tool may further include a size adjustment assembly disposed between the top jaw and the bottom handle, and between the bottom jaw and the top handle. The size adjustment assembly may include a tongue and a plurality of grooves to receive the tongue to define respective different grip sizes of the first grip portion. In an example embodiment, a largest grip size for the first grip portion defines a smallest grip size for the second grip portion, and a largest grip size for the second grip portion defines a smallest grip size for the first grip portion. In some cases, the top grip portion and the bottom grip portion each have an arcuate shape, and a radius of the top grip portion is different than (e.g., smaller than) a radius of the bottom grip portion. In an example embodiment, the top jaw and the bottom jaw remain in alignment over a range of grip sizes of the first grip portion, and the top grip portion and the bottom grip portion are only in alignment at a single grip size of the second grip portion. In some cases, the top grip portion and the bottom grip portion each have a plurality of serrated projections facing toward each other, and the top jaw and the bottom jaw each have serrated projections facing toward each other. In an example embodiment, the serrated projections have two different sizes at respective different portions of the top jaw and the bottom jaw. In some cases, the top grip portion is formed in a top handle cover of the top handle and the bottom grip portion is formed in a bottom handle cover of the bottom handle. In an example embodiment, the top grip portion and bottom grip portion are formed having a hardness that is different than a hardness of the top handle cover and the bottom handle cover. In this regard, for example, the top grip portion and bottom grip portion may have a Shore A hardness of between about 55-60, and the top handle cover and bottom handle cover may have a Shore A hardness of between about 80 and 90. In some cases, the top grip portion and bottom grip portion may be formed of high impact rubber coextruded with the top handle cover and the bottom handle cover, respectively. In an example embodiment, the top handle and bottom handle each have a T-shaped cross section at portions thereof that engage the top handle cover and bottom handle cover, respectively. In some cases, a width of the top handle and bottom handle is substantially the same over portions thereof that are covered by the top handle cover and bottom handle cover, respectively. In such an example, a height of the top handle and bottom handle may decrease as distal ends of the top handle and bottom handle are approached. In an example embodiment, end portions of each of the top handle and bottom handle are exposed from the top handle cover and bottom handle cover, respectively. In some cases, the end portions of each of the top handle and bottom handle are tapered to be substantially flat. In an example embodiment, a second top grip portion is provided in the top cover, and the second top grip portion aligns with the bottom grip portion at a different grip size of the second grip portion than a grip size at which the top grip portion aligns with the bottom grip portion. In an example embodiment, the top grip portion extends along a length of the top cover such that a portion of the top grip portion is aligned with a portion of the bottom grip portion for every grip size of the second grip portion. In some cases, an angled grip portion may be formed in each of the top jaw and the bottom jaw, the angled grip portion including surfaces that are angled relative to each other by about 60 degrees to form a V-shape. In an example embodiment, end portions of each of the top handle and the bottom handle are wider in at least some directions, but not all directions, around a perimeter of the end portions closest to the top and bottom handle covers than the top and bottom handle covers to hold the top and bottom handle covers in place.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A hand tool comprising:

a head section including a top jaw and a bottom jaw defining a first grip portion;

a handle section including a top handle and a bottom handle, the top jaw and the bottom handle forming a first unitary piece, and the bottom jaw and the top handle forming a second unitary piece, the first and second unitary pieces being joined at a pivot point; and a second grip portion including a top grip portion provided at the top handle and a bottom grip portion provided at the bottom handle, the top and bottom grip portions substantially facing each other, wherein the first grip portion is made of a metallic material and the second grip portion is made of a non-metallic material, wherein the hand tool further comprises a size adjustment assembly disposed between the top jaw and the bottom handle, and between the bottom jaw and the top handle, the size adjustment assembly including a tongue and a plurality of grooves to receive the tongue to define respective different grip sizes of the first grip portion, wherein the top grip portion is formed in a top handle cover of the top handle and the bottom grip portion is formed in a bottom handle cover of the bottom handle, and wherein the top grip portion and bottom grip portion are formed having a hardness different than a hardness of the top handle cover and the bottom handle cover.

2. The hand tool of claim 1:

wherein the top grip portion and the bottom grip portion each have an arcuate shape, and wherein a radius of the top grip portion is different than a radius of the bottom grip portion.

3. The hand tool of claim 1, wherein the second grip portion comprises a non-marking grip zone.

4. The hand tool of claim 1, wherein a largest grip size for the first grip portion defines a smallest grip size for the second grip portion, and a largest grip size for the second grip portion defines a smallest grip size for the first grip portion.

5. The hand tool of claim 1, wherein the top jaw and the bottom jaw remain in alignment over a range of grip sizes of the first grip portion, and wherein the top grip portion and the bottom grip portion are only in alignment at a single grip size of the second grip portion.

6. The hand tool of claim 1, wherein the top grip portion and the bottom grip portion each have a plurality of serrated projections facing toward each other, and wherein the top jaw and the bottom jaw each have serrated projections facing toward each other.

7. The hand tool of claim 6, wherein the serrated projections have two different sizes at respective different portions of the top jaw and the bottom jaw.

8. The hand tool of claim 1, wherein the top grip portion and bottom grip portion have a Shore A hardness of between about 55-60, and the top handle cover and bottom handle cover have a Shore A hardness of between about 80 and 90.

9. The hand tool of claim 1, wherein the top grip portion and bottom grip portion are formed of high impact rubber coextruded with the top handle cover and the bottom handle cover, respectively.

10. The hand tool of claim 1, wherein the top handle and bottom handle each have a T-shaped cross section at portions thereof that engage the top handle cover and bottom handle cover, respectively.

11. The hand tool of claim 10, wherein a width of the top handle and bottom handle is substantially the same over portions thereof that are covered by the top handle cover and bottom handle cover, respectively, and wherein a height of the top handle and bottom handle decreases as distal ends of the top handle and bottom handle are approached.

12. The hand tool of claim 1, wherein end portions of each of the top handle and bottom handle are exposed from the top handle cover and bottom handle cover, respectively.

13. The hand tool of claim 12, wherein the end portions of each of the top handle and bottom handle are tapered to be substantially flat.

14. The hand tool of claim 1, wherein a second top grip portion is provided in the top cover, the second top grip portion aligning with the bottom grip portion at a different grip size of the second grip portion than a grip size at which the top grip portion aligns with the bottom grip portion.

15. The hand tool of claim 1, wherein the top grip portion extends along a length of the top cover such that a portion of the top grip portion is aligned with a portion of the bottom grip portion for every grip size of the second grip portion.

16. The hand tool of claim 1, wherein an angled grip portion is formed in each of the top jaw and the bottom jaw, the angled grip portion including surfaces that are angled relative to each other by about 60 degrees to form a V-shape.

17. The hand tool of claim 1, wherein end portions of each of the top handle and the bottom handle are wider in at least some directions, but not all directions, around a perimeter of the end portions closest to the top and bottom handle covers than the top and bottom handle covers to hold the top and bottom handle covers in place.

* * * * *